US008585492B2

(12) United States Patent
Barclay et al.

(10) Patent No.: US 8,585,492 B2
(45) Date of Patent: Nov. 19, 2013

(54) MANAGEMENT OF ONLINE WAGERING COMMUNITIES

(75) Inventors: Brian J. Barclay, Atlanta, GA (US); Andrew C. Guinn, Chicago, IL (US); Daniel P. Louie, Chicago, IL (US); Darren Yat-man Ng, Chicago, IL (US); Tracey L. Wright, West Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 207 days.

(21) Appl. No.: 13/127,081

(22) PCT Filed: Nov. 9, 2009

(86) PCT No.: PCT/US2009/063768

§ 371 (c)(1), (2), (4) Date: May 2, 2011

(87) PCT Pub. No.: WO2010/054342

PCT Pub. Date: May 14, 2010

(65) Prior Publication Data

US 2011/0212767 A1 Sep. 1, 2011

Related U.S. Application Data

(60) Provisional application No. 61/112,942, filed on Nov. 10, 2008.

(51) Int. Cl.
*A63F 9/24* (2006.01)

(52) U.S. Cl.
USPC ..... 463/26

(58) Field of Classification Search
USPC ..... 463/26
See application file for complete search history.

(56) References Cited

U.S. PATENT DOCUMENTS 5,935,002 A * 8/1999 Falciglia ..... 463/19
2004/0162144 A1 8/2004 Loose et al.

(Continued)

FOREIGN PATENT DOCUMENTS

WO WO2010054342 5/2010

OTHER PUBLICATIONS

PCT Application No. PCT/US09/63768 International Preliminary Report on Patentability, Nov. 24, 2010 , 8 pages.

(Continued)

*Primary Examiner* — Corbett B Coburn
(74) *Attorney, Agent, or Firm* — DeLizio Gilliam, PLLC

(57) ABSTRACT

The document describes operations for managing online wagering game casinos. In some embodiments of the inventive subject matter, the operations include presenting wagering games to players in an online casino; facilitating messaging between the players and a wagering game attendant; reporting results of the wagering games to the attendant; and detecting, from the wagering game attendant, a request to present a community bonus opportunity to one or more of the players. The operations can also include presenting the community bonus opportunity to the players; detecting responses to the community bonus opportunity, wherein the responses are associated with the players; determining one or more winners of prizes offered in the community bonus opportunity; and awarding the prizes to the one or more winners.

7 Claims, 10 Drawing Sheets

(56) References Cited

U.S. PATENT DOCUMENTS

| | | | | |
|---|---|---|---|---|
| 2006/0003305 | A1 | 1/2006 | Kelmar | |
| 2006/0040733 | A1* | 2/2006 | Baerlocher et al. | 463/26 |
| 2006/0253784 | A1* | 11/2006 | Bower et al. | 715/738 |
| 2007/0060314 | A1 | 3/2007 | Baerlocher et al. | |
| 2007/0060317 | A1* | 3/2007 | Martin | 463/26 |
| 2009/0111573 | A1* | 4/2009 | Iddings | 463/25 |
| 2013/0006709 | A1* | 1/2013 | Kosta | 705/7.29 |

OTHER PUBLICATIONS

PCT Application No. PCT/US09/63768 International Search Report, Feb. 26, 2010 , 10 pages.

* cited by examiner

MANAGEMENT OF ONLINE WAGERING COMMUNITIES

RELATED APPLICATIONS

This application claims the priority benefit of U.S. Provisional Application Ser. No. 61/112,942 filed Nov. 10, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to online wagering game systems, and more particularly to online wagering game systems including management of online wagering communities.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross jurisdictional restrictions and requirements. Further, some online casinos have struggled adapting the online gaming industry to a traditionally non-wagering game business environment. As a result, wagering game manufacturers, casino operators, and online game providers face growing pains and challenges in making the online gaming industry appealing and profitable.

SUMMARY

In some embodiments, one or more machine-readable media having stored therein a program product, which when executed by a set of one or more processor units causes the set of one or more processor units to perform operations that comprise presenting wagering games to players in an online casino; facilitating messaging between the players and a wagering game attendant; reporting results of the wagering games to the attendant; detecting, from the wagering game attendant, a request to present a community bonus opportunity to one or more of the players; presenting the community bonus opportunity to the players; detecting responses to the community bonus opportunity, wherein the responses are associated with the players; determining one or more winners of prizes offered in the community bonus opportunity; and awarding the prizes to the one or more winners.

In some embodiments, the wagering game attendant is one of an employee of the online casino, a player who meets qualifications, and a bot.

In some embodiments, the bot is configured to analyze results of the wagering game, and suggest a side-bet to the players based on the results.

In some embodiments, the qualifications are at least one of an average amount wagered, frequency of play in the online casino, and a number of social contacts.

In some embodiments, the operations further comprise determining, based on the results, that one or more of the players are inactive, indicating the one or more inactive players to the wagering game attendant.

In some embodiments, a method for monitoring chat in a wagering game environment comprises presenting wagering games to a plurality of players in a wagering game environment; detecting an indication of one of the players engaged in questionable chat; soliciting, from the plurality of players, feedback about the questionable chat; determining that the questionable chat is offensive to some of the plurality of players based on the feedback; assigning a value to a reputation rating associated with the one of the players based on a level of offensiveness associated with the questionable chat; determining that the reputation rating of the one of the players is beyond a threshold; and revoking one or more privileges of the one of the players.

In some embodiments, the indication comprises at least one of an identifier of the one of the players, a quote of the questionable chat, and a description of the offensive chat.

In some embodiments, the level of offensiveness is determined based on at least one of comments in the feedback, how many of the players found the chat offensive, and a reputation of at least one of the players.

In some embodiments, the privileges comprise an ability to chat with the players, and an ability to participate in community bonus opportunities, and an ability to join a wagering game community.

In some embodiments, the privileges may be revoked temporarily.

In some embodiments, the method further comprises allowing the one of the players to rehabilitate the reputation rating.

In some embodiments, an apparatus for facilitating side betting on wagering games in an online wagering game environment comprises means for presenting the wagering games in the online wagering game environment; means for detecting a request to place a side bet in association with one or more of the wagering games; means for detecting conditions of the side bet, wherein one or more of the conditions are associated with players participating in the wagering game environment; means for accepting the side bet; means for determining that the conditions of the side bet have been met; means for determining an award for the side bet; means for depositing the award in an online wagering account.

In some embodiments, the apparatus further comprises means for detecting additional conditions for the side bet, wherein the additional conditions are entered by a wagering game attendant.

In some embodiments, the request to place a side bet is received from a player.

In some embodiments, the request to place a side bet is received from a wagering game attendant.

In some embodiments, an apparatus comprises a wagering game controller configured to present wagering games, and a wagering game attendant controller configured to present wagering games to players in an online casino, facilitate messaging between the players and a wagering game attendant, and report results of the wagering games to the attendant. The wagering game attendant controller can also detect, from the wagering game attendant, a request to present a community bonus opportunity to one or more of the players, present the community bonus opportunity to the players, and detect responses to the community bonus opportunity, wherein the responses are associated with the players. The wagering game attendant can also determine one or more winners of prizes offered in the community bonus opportunity; and award the prizes to the one or more winners.

In some embodiments, the apparatus further comprises a side betting controller configured to receive side bet conditions entered through a user interface and to place the side-bets.

In some embodiments, the apparatus further comprises a newsfeed controller configured to detect wins by the players and report the wins to subscribes of a newsfeed.

In some embodiments, the apparatus further comprises chat controller configured to deliver chat messages to the players and determines that ones of the chat messages are offensive by soliciting feedback from the players.

In some embodiments, a computer-implemented method comprises presenting wagering games to players in an online casino; facilitating messaging between the players and a wagering game attendant; reporting results of the wagering games to the attendant; detecting, from the wagering game attendant, a request to present a community bonus opportunity to one or more of the players; presenting the community bonus opportunity to the players; detecting responses to the community bonus opportunity, wherein the responses are associated with the players; determining one or more winners of prizes offered in the community bonus opportunity; and awarding the prizes to the one or more winners.

In some embodiments, the wagering game attendant is one of an employee of the online casino, a player who meets qualifications, and a bot.

In some embodiments, the bot analyzes results of the wagering game; and suggests a side-bet to the players based on the results.

In some embodiments, the qualifications are at least one of an average amount wagered, frequency of play in the online casino, and a number of social contacts.

In some embodiments, the computer-implemented method further comprises determining, based on the results, that one or more of the players are inactive, indicating the one or more inactive players to the wagering game attendant.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example wagering game machine architectures. The third section describes example operations performed by some embodiments and the fourth section describes example wagering game machines in more detail. The fifth section presents some general comments.

Introduction

This section provides an introduction to some embodiments of the invention.

Online casinos can leverage wagering communities to make the online wagering game experience more interesting and exciting. In some embodiments of the inventive subject matter, wagering communities allow players participating in online wagering to interact and associate with each other. Functionality can be implemented in a wagering community to collect information about players in the community and report player status. For example, icons appearing next to a player's name can indicate that the player is on a winning streak. As another example, a newsfeed can notify the community when a player hits a big jackpot or bonus. In some embodiments, players can use reporting mechanisms, such as newsfeeds, to formulate side-bets involving other players. Additionally, a wagering attendant can utilize collected information to encourage inactive players, to suggest side-bets, and present community bonus opportunities.

In some embodiments, online communities include mechanisms for automatically dealing with offensive chat and interactions between players. For example, when a player is reported for engaging in questionable behavior, instead of involving a moderator, some embodiments allow other players in the wagering community to determine whether the behavior is offensive. If behavior is deemed offensive by the community, the offending player may be subject to some type of punishment (e.g., a temporary ban, a permanent ban, revocation of certain privileges, etc). Some of these embodiments are described in FIG. 1.

Figure 1:
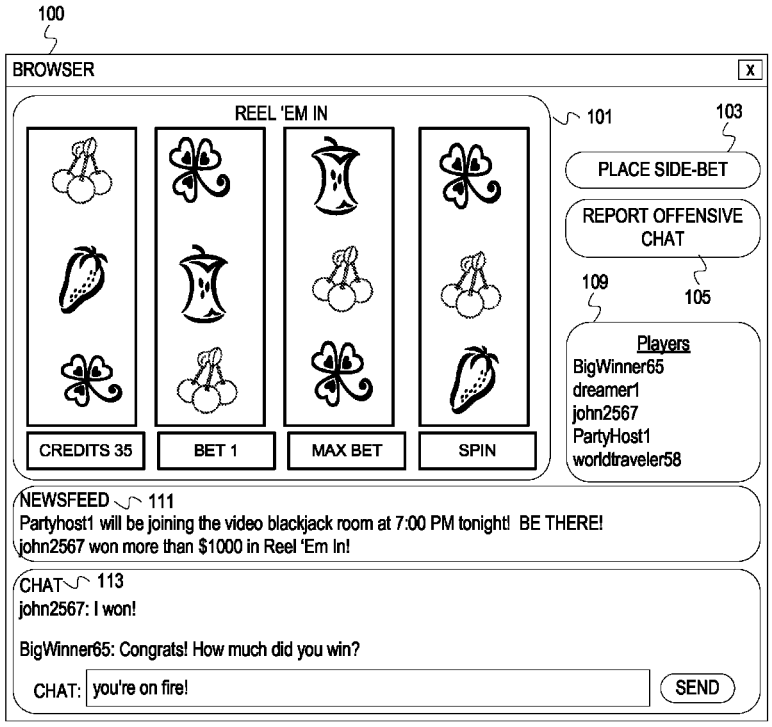
FIG. 1 is an example conceptual diagram of a wagering community integrated with an online wagering game interface.

FIG. 1 is an example conceptual diagram of a wagering community integrated with an online wagering game interface. A wagering game interface is presented in a web browser window 100. The wagering game interface comprises a wagering game display area 101, a place side-bet button 103, a report offensive chat button 105, a player area 109, a newsfeed display area 111, and a chat interaction area 113.

The wagering game display area 101 presents a wagering game to a player. Examples of wagering games include spinning-real slots, video poker, video blackjack, etc. The wagering game display area 101 also displays the player's credits and allows the player to make wagers.

The place side-bet button 103 allows the player to create a side-bet involving one or more player's in the wagering community. When a player clicks the place side-bet button 103, a side-bet builder is displayed (see discussion of FIG. 8). The side-bet builder allows the player to specify parameters of a side-bet and place the side-bet. The side-bet builder may be displayed in web browser window 100 or in another web browser window. If the side-bet builder is displayed in the web browser window 100, it may or may not overlap other elements in the wagering game interface including the wagering game display area 103, newsfeed area 111, chat interaction area 113, etc. Example side-bet parameters include one or more player identifiers, a wager amount, a condition, etc.

The report offensive chat button 105 allows a player to report chat that the player considers to be offensive. When a player clicks the report offensive chat button 105, the player is prompted to provide information about the offensive chat. Information provided about the offensive chat can include a name of a player engaged in the offensive chat, a description of the offensive chat, a quote of the player engaged in the offensive chat, etc. In addition, the player engaged in offensive chat may be identified by highlighting the player's name in the player area 109 before clicking the report offensive chat button 105. When a report is submitted, players in the wagering community are solicited for feedback about the offensive chat. Based on the feedback, a chat controller can determine if the chat is deemed offensive by the community. If the chat is deemed offensive, the chat controller can assign a value to a reputation rating of the player engaged in offensive chat, where the value is based on the level of offensiveness. The level of offensive may be determined by the chat controller or by the community when feedback is provided. If a player's reputation rating falls below a certain threshold, the player may be subject to punishment including a temporary or permanent ban from participating in chat, removal of the player's account, etc.

The player area 109 lists the players currently signed in to the wagering community. The wagering community may be linked to a particular wagering game. When a player begins a wagering session in a wagering game, the player may be automatically signed in to a wagering community associated with the wagering game. However, the wagering community may not be linked to any one particular wagering game. For example, the wagering community may be associated with an online casino rather than a particular wagering game offered by the online casino. In some instances, players can choose to participate in wagering communities while engaging in a wagering session. A player's profile information can be viewed by clicking on a name in the player area 109. Other options (e.g., invite player to a private chat session, send an email to a player, etc.) may be available for players listed in the player area 109.

The newsfeed display area 111 displays real-time news information associated with an online casino. A newsfeed may be associated with a particular wagering game. For example, the newsfeed reports when a player wins in the wagering game. A newsfeed may be associated with the online casino. For example, the newsfeed reports wins over a certain monetary threshold for all games available in the online casino. As another example, the newsfeed reports events (e.g., tournaments, contests, etc.) hosted by the online casino. In some embodiments, a player can configure the newsfeed display area 111 to display one or more selected newsfeeds.

The chat interaction area 113 allows a player to chat with other players in the wagering community. The chat interaction area 113 displays chat messages and contains an input text box that allows the player to send chat messages. Although this example depicts text based chat, embodiments are not so limited. Voice chat and a combination of voice and text based chat may be available.

Although FIG. 1 describes some embodiments, the following sections describe many other features and embodiments.

Operating Environment

This section describes an example operating environment and presents structural aspects of some embodiments. This section includes discussion about online wagering game networks.

Online Wagering Game Networks

Figure 2:
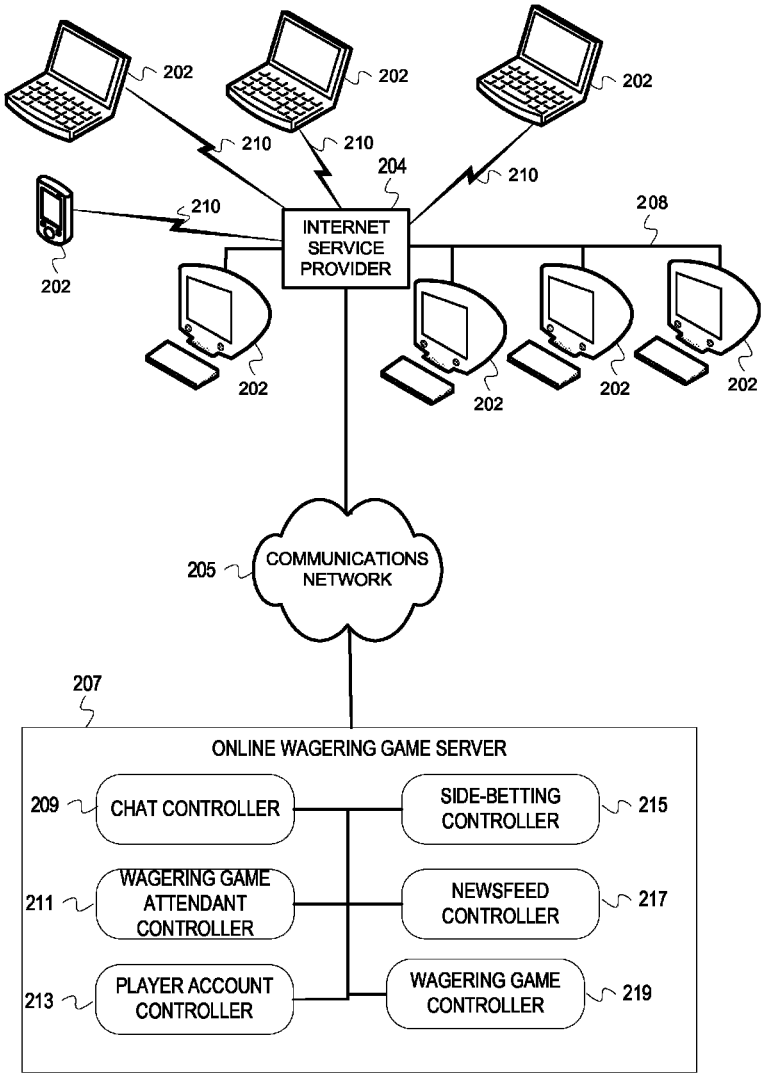
FIG. 2 is a block diagram illustrating an online wagering game network, according to example embodiments of the invention.

FIG. 2 is a block diagram illustrating an online wagering game network, according to example embodiments of the invention. As shown in FIG. 2, the wagering game network includes an online wagering game server 207 and an internet service provider 204 connected to a communications network 205.

The online wagering game server 207 comprises a chat controller 209, a wagering game attendant controller 211, a player account controller 213, a side-betting controller 215, a newsfeed controller 217, and a wagering game controller 219. The chat controller 209 displays chat messages to the community and determines if chat is offensive by soliciting feedback from the community. The wagering game attendant controller 211 collects information about players and wagering game results and reports the information to a wagering game attendant. The wagering game attendant controller 211 also manages community bonus opportunities indicated by the wagering game attendant by presenting the community bonus opportunities, collecting responses from the players and determining winners of prizes offered in the community bonus opportunity. The player account controller 213 manages player accounts. Player accounts are used to fund wagers, receive monetary awards and enable access to wagering games and online wagering communities. The side-betting controller 215 allows players to create side-bets involving other players in the wagering community and place the side-bets. The side-bet controller also can determine winnings if side-bet parameters are met and deposits the winnings or debits a wager from a player's account balance if side-bet parameters are not met. The newsfeed controller 217 detects wins by players participating in wagering games and reports information about the wins in one or more newsfeeds. The wagering game controller 219 presents wagering games. In some instances, the wagering game controller 219 provides results of wagering games to the wagering game devices 202, which in turn use locally stored content to present the results. However, the controller 219 can provide results, content, and other assets needed for presenting wagering games.

A plurality of wagering game devices 202 are connected to the internet service provider 204 via wireless communication links 210 and wired communication links 208. The wired and wireless communication links can employ any suitable connection technology, such as Bluetooth, 802.11, Ethernet, public switched telephone networks, SONET, etc. The wagering game devices 202 may be any device (e.g., a desktop computer, a laptop computer, a personal digital assistant, etc.) capable of accessing the Internet and displaying web pages.

In some embodiments, either the wagering game devices 202 (client) or the online wagering game server 206 can provide functionality that is not directly related to game play. For example, account transactions and account rules may be managed centrally (e.g., by the online wagering game server 207) or locally (e.g., by logic on the wagering game devices 202). Other functionality not directly related to game play may include presentation of advertising, system quality or security checks, etc.

Any of the online wagering game network components (e.g., the online wagering game server 207) can include hardware and machine-readable media including instructions for performing the operations described herein.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

The section will discuss FIGS. 3-10. The discussion of FIGS. 3 and 7 will describe operations for facilitating and managing chat in online gaming environments. The discussion of FIGS. 4-5 will describe operations for facilitating interactions between wagering game attendants and players. The discussion of FIG. 6 will describe operations for reporting win information in a newsfeed. The discussion of FIGS. 8-10 will describe operations for facilitating side-betting.

Figure 3:
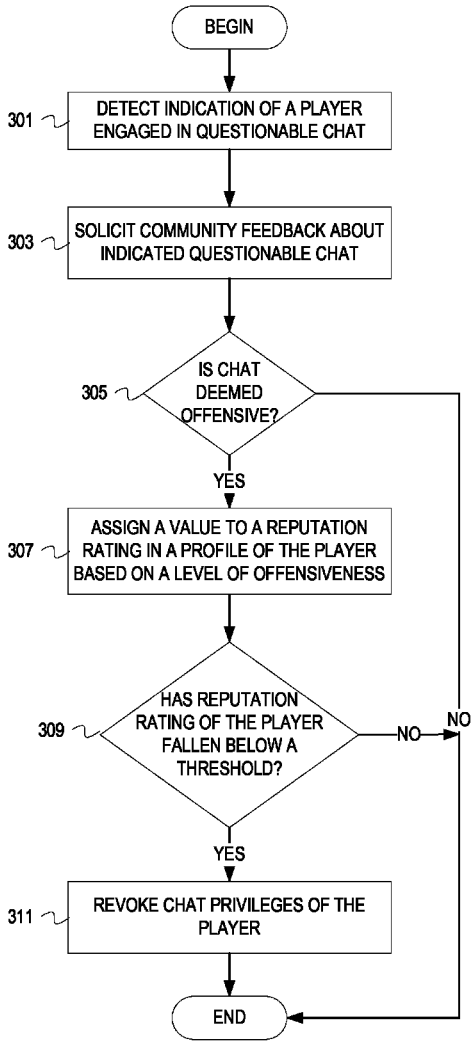
FIG. 3 is a flowchart depicting example operations for automatically determining if chat is offensive.

FIG. 3 is a flowchart depicting example operations for automatically determining if chat is offensive. Flow begins at block 301, where the chat controller 209 detects an indication of a player engaged in questionable chat. The indication can include an e-mail, an instant message, a button click, etc. For example, a first player highlights a name of a second player in the player area 109 and clicks the report offensive chat button 105 to report the second player for engaging in offensive chat. In addition to identifying the second player, the first player may be prompted to provide more information about the questionable chat including a quote of the questionable chat, a description of the questionable chat, etc.

At block 303, the chat controller 209 solicits community feedback about the questionable chat. Feedback may be solicited from all of players or a portion of the players (e.g., a random sampling of the players). For example, the chat controller 209 can present a poll to players in the community. The poll may ask, "Did you consider comment <quote of indicated questionable chat> made by <player identifier> to be offensive?" The players in the community can respond "Yes" or "No." As another example, the chat controller 209 can ask players in the community to rank the offensiveness of the chat on a scale.

At block 305, it is determined if the chat is deemed offensive based on community feedback. For example, the chat may be deemed offensive if a certain percentage of players consider the chat to be offensive. Determining if the chat is offensive may also be based on a player's offensive chat history.

At block 307, the chat controller 209 assigns a value to a reputation rating in a profile of the player engaged in questionable chat, where the value is based on a level of offensiveness. The level of offensiveness may be determined based on feedback from the community. For example, the community members ranked the level offensiveness of the chat. As another example, the level of offensiveness is determined by the percentage of players in the community that considered the chat offensive. If 0-25 percent of the community considered it offensive, then level A. If 26-50 percent considered, then level B. If 50-75 percent, then level C. If 75-100 percent, then level D. The reputation rating can be a numeric representation of a player's overall standing in the wagering community. Engaging in offensive chat lowers a player's reputation rating. A player's reputation rating may also be lowered based on other criteria. For example, the player's reputation rating may be lowered based how many of the other players in the community have blocked communication from the player.

At block 309, the chat controller 209 determines if the reputation rating of the player has fallen below a threshold. In some embodiments, players' reputations can be represented in various ways such, ascending numerical scales, descending numerical scales, non-numerical scales, etc. Thus, some chat controllers may employ other techniques for determining that player reputations meet conditions for being treated offensive. If the reputation rating is below the threshold (or otherwise indicates a certain level of offensive behavior), flow continues at block 311. If the reputation rating is not below the threshold, flow ends.

At block 311, the chat controller 209 revokes chat privileges of the player. For example, the player may not be able to send chat messages, but can view messages sent by other players. As another example, the player may not be able to participate in community bonus opportunities offered to the wagering community. In addition, the player may be banned from the wagering community. Chat privileges may be revoked temporarily or permanently based on level of offensiveness, number of incidents, community consensus, etc. In some embodiments, the chat controller notifies the player if chat privileges are revoked. In some instances, the player may be able to view feedback submitted by other players associated with the offensive chat. In other instances, players may anonymously submit feedback about offensive chat.

In addition to a player's reputation being lowered (or otherwise modified) for offensive behavior, good behavior can raise the player's reputation rating. A high reputation rating can protect a player from losing chat privileges if they inadvertently offend another player. Engaging in good behavior may also allow a player to rehabilitate his or her reputation rating. Examples of good behaviors include responding to community polls, participating in community bonus opportunities, etc. A player's reputation rating may also be enhanced over time, such as by the number of other players who have added the player as a friend. Players may be given incentives (e.g., entries in contests, virtual trophies, virtual goods, etc.) for maintaining a high reputation rating. Although examples refer to chat, embodiments may be implemented in forums, newsgroups, and other suitable settings.

An appeal process can be implemented to prevent players from maliciously revoking privileges of another player. If a player feels that his or her reputation rating has been lowered unfairly, the player can submit an appeal on the community decision. A moderator, and perhaps the community, may decide the outcome of the appeal. The moderator can restore the player's reputation rating and any privileges that were revoked when the player's reputation was lowered.

Figure 4:
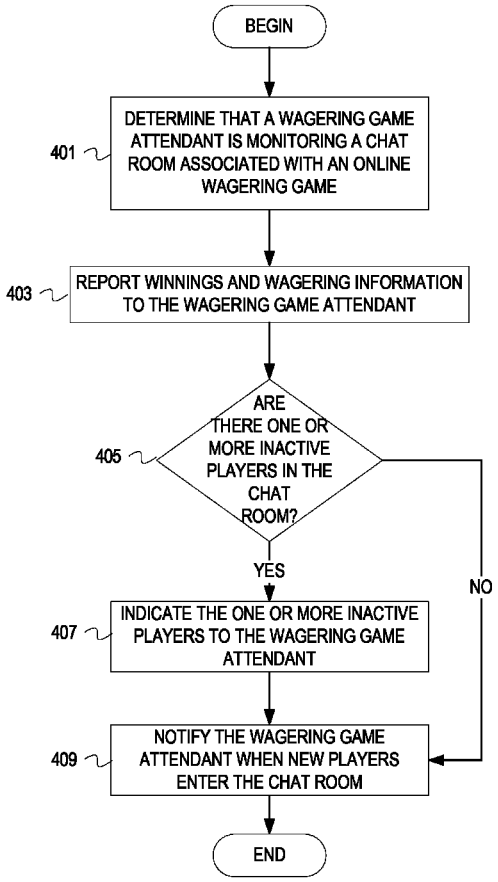
FIG. 4 is a flowchart depicting example operations for collecting wagering game and player information for a wagering game attendant.
Figure 5:
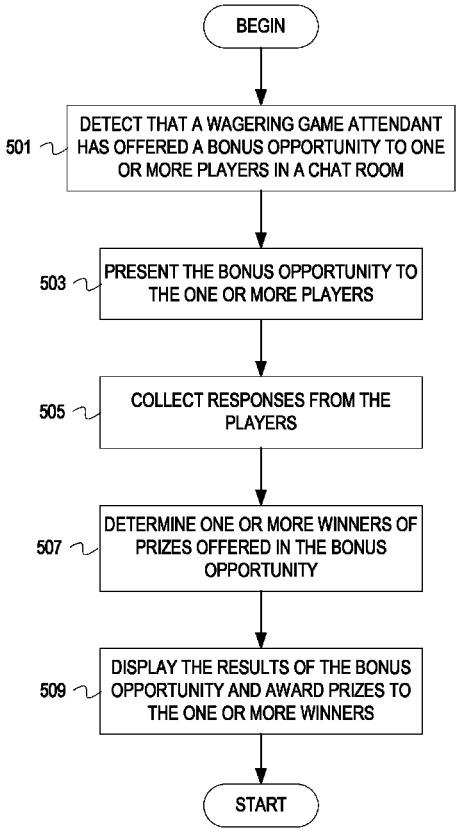
FIG. 5 is a flowchart depicting example operations for managing community bonus opportunities.

This discussion will now turn to embodiments that facilitate interactions between a wagering game attendant and online players. In some embodiments, a wagering game attendant can chat with players, promote chat between other players, offer community bonus awards, and more. The online wagering game server may facilitate the chat, bonus games, etc. FIGS. 4 and 5 describe these embodiments in greater detail.

FIG. 4 is a flowchart depicting example operations for collecting wagering game and player information for a wagering game attendant. Flow begins at block 401, where the wagering game attendant controller 211 determines that a wagering game attendant is monitoring a chat room associated with an online wagering game. The wagering game attendant may be an employee of the online casino who creates a more exciting wagering environment by interacting with players in chat and offering side-bets and community bonus opportunities. The wagering game attendant may monitor more than one chat room at a time.

At block 403, the wagering game attendant controller 211 reports winnings and wagering information to the wagering game attendant. The wagering game attendant can use the winnings information to suggest one or more side-bets to the players in the chat room. For example, the wagering game attendant may offer the following, in the form of a side-bet: "Player123 has had three successive wins, do you think he will keep winning? Place your wager on 'yes' or 'no'." The wagering game attendant can also use the wagering information to determine if his or her efforts in the chat room are leading to more wagering activity.

At block 405, the wagering game attendant controller 211 determines if there are one or more inactive players in the chat room. An inactive player is a player who has not placed a wager in a certain period of time. The period of time may be selected by the wagering game attendant or be a default value. If there are one or more inactive players in the chat room, flow continues at block 407. If there are no inactive players in the chat room, flow continues at block 409.

At block 407, the wagering game attendant controller 211 indicates the one or more inactive players to the wagering game attendant. The wagering game attendant controller 211 can indicate the inactive players by sending a message to the wagering game attendant, displaying an icon next to the player's name, etc. The wagering game attendant may engage inactive players in chat to encourage them to return to game play. The wagering game attendant may also send an inactive player an e-mail, an instant message, a short message service (SMS) text message, etc. The wagering game attendant may also offer community bonus opportunities to the one or more inactive players to spark their interest in the wagering game.

At block 409, the wagering game attendant controller 211 notifies the wagering game attendant when new players enter the chat room. In turn, the wagering game attendant may welcome new players to the chat room and inform them of active community bonus opportunities and other events. This discussion continues with a description of operations for conducting bonus events offered by wagering game attendants.

FIG. 5 is a flowchart depicting example operations for managing community bonus opportunities. Flow begins at block 501, where the wagering game attendant controller 211 detects that a wagering game attendant has entered input to cause the online wagering game server to offer a community bonus opportunity to one or more players in a chat room. The community bonus opportunity may be a trivia game, a game of chance (e.g., a slots game), a skill game (e.g., video pin ball), a side-bet, etc. The community bonus opportunity may be private or public. For example, a private bonus opportunity is offered to players whose wagers are over a certain threshold. As another example, a public community bonus opportunity is offered to all players in the chat room.

At block 503, the wagering game attendant controller 211 presents the community bonus opportunity to the one or more players. The community bonus opportunity may be presented as a message (e.g., a chat message, a private message, an instant message, etc). For example, the wagering game attendant controller 211 sends a chat message inviting the one or more players to a slot tournament. The players can click a link in the chat message to enter the tournament. The wagering game attendant controller 211 may present the community bonus opportunity in a pop-up window that is either a new browser window or a window embedded in the wagering game display area 101. The embedded window may obscure parts of the wagering game display area or replace one or more areas. For example, the wagering game attendant controller displays trivia game community bonus opportunity by opening an embedded pop-up window that replaces the player area 109 in wagering game display area 101. When the community bonus opportunity expires, the player area 109 reappears. In addition, community bonus opportunities may be presented in one or more newsfeeds.

At block 505, the wagering game attendant controller 211 collects responses from the players. The responses may be collected from the chat interface or another graphical user interface (GUI) depending on the community bonus opportunity format. For example, a trivia game is presented in a new browser window. Possible answers to a trivia questions may be displayed in a multiple-choice format. Responses may be collected when a player chooses a radio button associated with an answer and clicks a submit button.

At block 507, the wagering game attendant controller 211 determines one or more winners of prizes offered in the community bonus opportunity. The prizes may or may not be monetary. Examples of non-monetary prizes include virtual trophies, free spins in a spinning reel game, merchandise, etc. Determining the one or more winners can be based on the type of community bonus opportunity offered. For example, the community bonus opportunity may be a slot tournament. The players with the three highest scores are determined to be winners of the first, second and third prizes. As another example, the community bonus opportunity may be a trivia game with a single prize. The wagering game attendant controller 211 can select one of the players who correctly answered a trivia question as a prize winner. The selection may be based on a random draw or other criteria (e.g., the first player to correctly answer the trivia question).

At block 509, the wagering game attendant controller 211 displays the results of the community bonus opportunity and awards prizes to the one or more winners. The results of the community bonus opportunity may be displayed in the chat interface, in one or more newsfeeds, on a winner's webpage, etc.

In some embodiments, the wagering game attendant controller 211 can measure the wagering game attendant's performance by determining increases or decreases in wagering activity, number of players in the chat room, etc. The controller 211 may ask players to respond to surveys about the wagering game attendant's performance and whether the wagering game attendant made the wagering game community more exciting.

Although some examples refer to an online casino employee acting as a wagering game attendant, embodiments are not so limited. A player who meets certain qualifications may act as a wagering game attendant. Qualifications may include an average amount wagered, a length of time the player has been a member of the online casino, a number of players who have added the player as a friend, etc. The community bonus opportunities and information provided to a player acting as a wagering game attendant may be limited. Alternatively, the wagering game attendant could be a bot that processes information reported from the wagering game attendant controller 211 and responds appropriately. The bot may be implemented in program code, hardware, or a combination of program code and hardware. In some instances, the bot can be part of a wagering game attendant controller.

In addition to a wagering game attendant initiating a community bonus opportunity, the community bonus opportunity can be triggered by a condition in a wagering game. For example, in a spinning reels game, certain reel combinations can trigger community bonus events (e.g., a row of question marks appear across a payline). In other instances, players may receive bonus awards without directly participating in bonus events. For example, a player in the community may be asked to respond to a multiple-choice question. If the player guesses the correct answer, the player gets a bonus prize. If the player does not guess the correct answer, the other players in the community get a bonus prize.

Virtual goods may be available for sale in the wagering game community in addition to non-monetary prizes offered in bonus opportunities. For example, players may be able to purchase limited edition lucky charms. Virtual goods may be displayed in a player's profile and may grant special privileges to the player (e.g., access to unique content, pre-notification of bonus events, etc.) Players may also be able to send virtual goods to other players as gifts.

Figure 6:
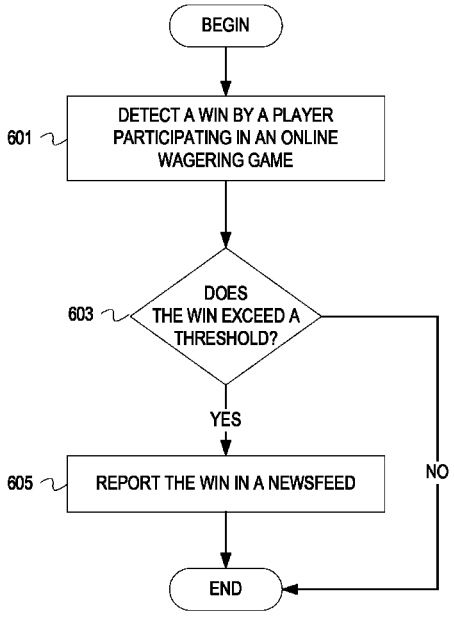
FIG. 6 is a flow chart depicting example operations for reporting win information from an online wagering game in a newsfeed.

An online casino can use newsfeeds to create excitement for its wagering games by keeping players informed of wins, community bonus opportunities, and events. Newsfeeds can lead to increased wagering activity as players may seek to participate in the hottest wagering games. Newsfeeds also help players to determine big winners, allowing them to take part in the winners' success by placing side-bets associated with the winners. FIG. 6 is a flow chart depicting example operations for reporting win information from an online wagering game in a newsfeed. Flow begins at block 601, where the newsfeed controller 217 detects a win by a player participating in an online wagering game. The win comprises monetary and/or non-monetary prizes.

At block 603, the newsfeed controller 217 determines if the win exceeds a threshold. The threshold may be established based on the amount of traffic on an online casino website. For example, if more than 5,000 players are participating in wagering games, only wins over $1000 will be displayed in a newsfeed. If the win exceeds the threshold, flow continues at block 605. If the win does not exceed the threshold, flow ends.

At block 605, the newsfeed controller 217 reports the win in a newsfeed. The newsfeed may only be available on the online casino website or may be broadcast externally. The newsfeed controller can publish news items using any suitable publication technology, such as Really Simple Syndication (RSS).

The newsfeed can include links to more information. For example, the newsfeed may announce a contest with a link to the contest rules. As another example, an item in the newsfeed reporting a win may include a link to a winner's profile, a side-bet builder, a video showing a replay of the win, etc.

Figure 7:
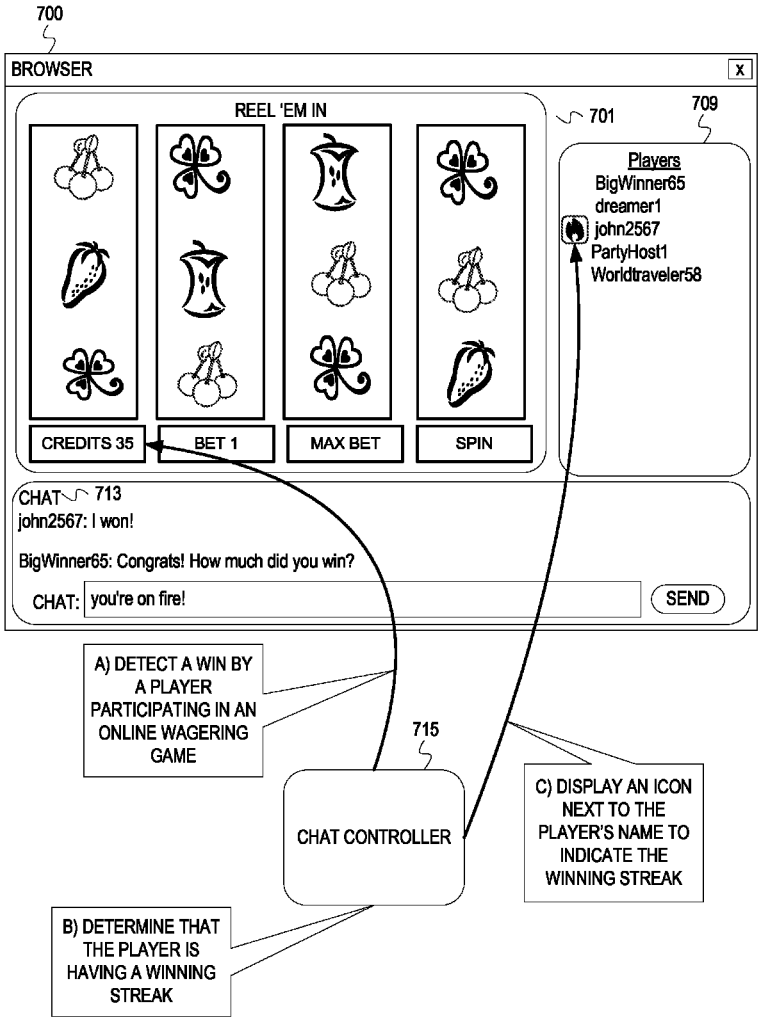
FIG. 7 is an example conceptual diagram of displaying status icons based on a player's wagering game performance.

In addition to providing player information in a newsfeed, status icons displayed next to a player's name can indicate player performance in a wagering game. Status icons can indicate players on winning and losing streaks. The status icons can assist a player in making a side-bet on whether another player will continue winning or losing. FIG. 7 is an example conceptual diagram of displaying status icons based on a player's wagering game performance. A wagering game interface is presented in a web browser window 700. The wagering game interface comprises a wagering game display area 701, a player area 709 and a chat interaction area 713. The wagering game display area 101 presents a wagering game to a player. The player area 109 lists one or more players currently playing the wagering game. The chat interaction area 113 allows a player to chat with other players playing the wagering game.

At stage A, a chat controller 715 detects a win by a player participating in an online wagering game.

At stage B, the chat controller 715 determines that the player is having a winning streak. Determining that a player is on a winning streak comprises determining that a player has won a specified number of times over a certain period of time. For example, a player is considered to be on a winning streak when they have won ten times in last five minutes.

At stage C, the chat controller 715 displays an icon next to the player's name to indicate the winning streak. Different icons or different icon colors may be used to indicate different levels of winning. For example, a white flame icon indicates that a player has won fifty percent of his or her wagers and a red flame icon indicates that a player has won 75% of his or her wagers. Icons can indicate winning or losing streaks, average amounts wagered, entering a bonus, etc.

Figure 8:
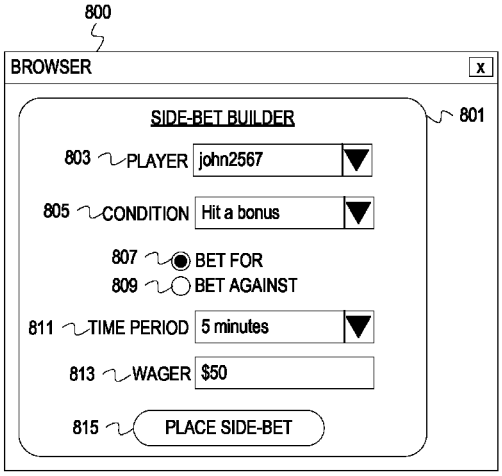
FIG. 8 is an example conceptual diagram of a side-bet builder interface. A side-bet builder interface 801 is displayed in a browser 800.

Side-betting enhances the community aspect of online wagering games and makes them more interesting by providing other opportunities to win. A player who is not having much luck in a wagering game can place side-bets associated with other players who are winning. Because the unlucky player can use a side-bet to win vicariously through another player, the unlucky player may be less likely to leave the online casino due to boredom. Allowing players to place bets on wagering activities of other players may increase overall wagering activity for an online casino. FIG. 8 is an example conceptual diagram of a side-bet builder interface. A side-bet builder interface 801 is displayed in a browser 800. The side-bet builder interface 801 may be displayed in its own browser window or may be embedded in a wagering game interface.

The side-bet builder interface 801 comprises fields for allowing a player to input side-bet parameters. In this example, the side-bet builder interface comprises a "player" drop-down list 803, a "condition" drop-down list 805, a "bet for" radio button 807, a "bet against" radio button 809, a "time period" drop-down list 811, a "wager" text box 813, and a "place side-bet" button 815.

The "player" drop-down list 803 is a list of players participating in a wagering game. The "player" drop-down list 803 allows a player to associate a side-bet with one or more players. In this example, the side-bet is associated with player john2567. Newsfeeds and status icons help a player to determine which players to associate with side-bets and what parameters are appropriate for the side-bets.

The "condition" drop-down list 805 displays possible side-bet conditions. Conditions are possible outcomes or events in a wagering game. Side bet can be placed on a number of different conditions including a player hitting a bonus, winning a specified amount, receiving a certain card combination, etc. Side-bets can also allow one player to bet on paylines of a second player's spinning reel slot game. In this example, the condition is "Hit a bonus."

The "bet for" radio button 807 and the "bet against" radio button 809 allow a player to specify if they are betting on the condition or against the condition, respectively. In this example, the player is betting for the condition that john2567 will "Hit a bonus."

The "time period" drop-down list 811 allows the player to specify a time period in which the condition should take place. In this example, the side-bet is "Player john2567 will hit a bonus within 5 minutes."

The "wager" text box 813 allows the player to specify a wager for the side-bet. If the side-bet parameters are met, the winnings are determined, at least in part, on the wager. If the side-bet parameters are not met, the wager is deducted from the player's online wagering account.

When the "place side-bet" button 815 is clicked, the side-betting controller 215 places the side-bet and monitors it to determine if the side-bet parameters have been met.

Additionally, a player may place a side-bet that benefits one or more other players ("gifting side-bet") participating in the wagering game. If the conditions of the gifting side-bet are met, the one or more other players receive a payout. For example, a player may have just won a jackpot and would like to wager part of the jackpot in a gifting side-bet benefiting the player's friends. As another example, the player may place a side-bet recommended by a wagering game attendant. The player may receive a large payout from the recommended side-bet and would like to tip the wagering game attendant. The player can place a gifting side-bet for the wagering game attendant by manually configuring a gifting side-bet in the side-bet builder interface 801. The player may also set preferences in the player's account settings that would automatically place a gifting-side bet when specified conditions (e.g., a win above a threshold, a successful side-bet, a win in a bonus game, etc.) are met. Preferences may include conditions of a gifting side-bet, an indication of one or more players to benefit from the side-bet, etc.

Figure 9:
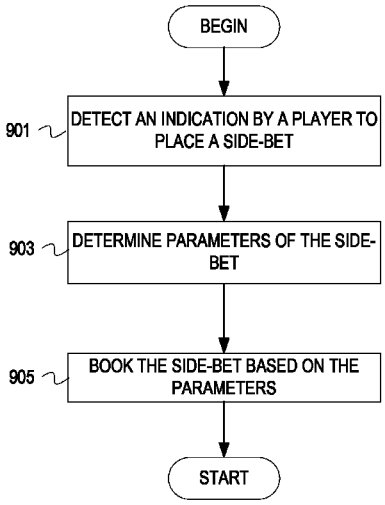
FIG. 9 is a flowchart depicting example operations for placing a side-bet.

FIG. 9 is a flowchart depicting example operations for placing a side-bet. Flow begins at block 901, where the side-betting controller 215 detects an indication by a player to place a side-bet. For example, the player may click the place side-bet button 815 in side-bet builder interface 801. As another example, a player may indicate acceptance of a side-bet offered by a wagering game attendant in a chat message.

At block 903, the side-betting controller 215 determines parameters of the side-bet. For example, the side-betting controller 215 determines the values of the fields in the side-bet builder interface 801.

At block 905, the side-betting controller 215 books the side-bet. In some embodiments, booking the side-bet comprises storing the side bet parameters in a side-bet data structure accessible by the side-betting controller 215.

Figure 10:
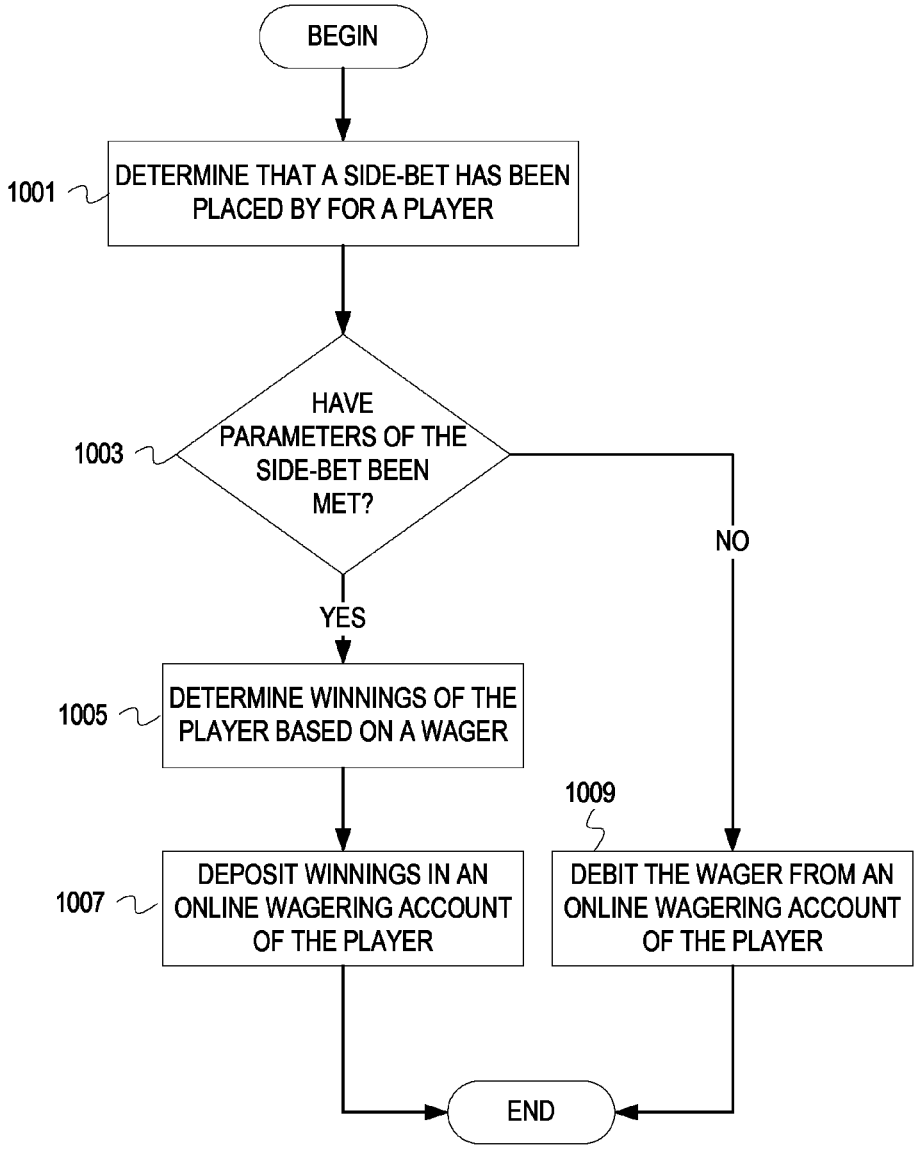
FIG. 10 is a flowchart depicting example operations for determining if side-bet parameters have been met.

FIG. 10 is a flowchart depicting example operations for determining if side-bet parameters have been met. Flow begins at block 1001, where the side-betting controller 215 determines that a side-bet has been placed for a player. When a side-bet is placed, parameters of the side-bet are stored in a data structure accessible to the side-betting controller 215.

At block 1003, the side-bet controller 215 determines if the parameters of the side-bet have been met. The side-betting controller 215 steps through each side-bet in the data structure to determine if the parameters have been met. For example, one side-bet in the data structure is "Player john2567 will hit a bonus within 5 minutes." The side-betting controller 215 determines if 5 minutes has expired since the side-bet was placed. If 5 minutes has expired, the side-betting controller 215 determines if the player john2567 hit a bonus between the time the side-bet was placed and 5 minutes later. If the parameters of the side-bet have been met, flow continues at block 1003. If the parameters of the side-bet were not met, flow continues at block 1009.

At block 1005, the side-betting controller 215 determines winnings of the player based, at least in part, on the wager.

At block 1007, the side-betting controller 215 deposits the winnings in an online wagering account of the player.

If the side-bet parameters were not met, the side-betting controller 215 debits the wager from an online wagering account of the player at block 1009.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. One or more non-transitory machine-readable storage media having stored therein a program product, which when executed by a set of one or more processor units causes the set of one or more processor units to perform operations that comprise:

presenting wagering games to players in an online casino;

facilitating messaging between the players and a wagering game attendant;

reporting results of the wagering games to the wagering game attendant;

detecting, from the wagering game attendant, a request to present a community bonus opportunity to one or more of the players;

presenting the community bonus opportunity to the players;

detecting responses to the community bonus opportunity, wherein the responses are associated with the players;

determining one or more winners of prizes offered in the community bonus opportunity;

and awarding the prizes to the one or more winners wherein the wagering game attendant is a bot that is further configured to analyze results of the wagering game, and suggest a side-bet to the players based on the results.

2. The non-transitory machine-readable medium of claim 1, the operations further comprising:

determining, based on the results, that one or more of the players are inactive indicating the one or more inactive players to the wagering game attendant.

3. An apparatus comprising:

a wagering game controller configured to present wagering games;

a wagering game attendant controller configured to, present wagering games to players in an online casino;

facilitate messaging between the players and a wagering game attendant;

report results of the wagering games to the attendant;

detect, from the wagering game attendant, a request to present a community bonus opportunity to one or more of the players;

present the community bonus opportunity to the players;

detect responses to the community bonus opportunity, wherein the responses are associated with the players;

determine one or more winners of prizes offered in the community bonus opportunity;

and award the prizes to the one or more winners and a newsfeed controller configured to detect wins by the players and report the wins to subscribes of a newsfeed.

4. The apparatus of claim 3 further comprising:

a side betting controller configured to receive side bet conditions entered through a user interface and to place the side-bets.

5. The apparatus of claim 3 further comprising:

chat controller configured to deliver chat messages to the players and determines that ones of the chat messages are offensive by soliciting feedback from the players.

6. A computer-implemented method comprising:

presenting wagering games to players in an online casino;

facilitating messaging between the players and a wagering game attendant;

reporting results of the wagering games to the wagering game attendant;

detecting, from the wagering game attendant, a request to present a community bonus opportunity to one or more of the players;

presenting the community bonus opportunity to the players;

detecting responses to the community bonus opportunity, wherein the responses are associated with the players;

determining one or more winners of prizes offered in the community bonus opportunity; and awarding the prizes to the one or more winners wherein the wagering game attendant is a bot that is further configured to analyze results of the wagering game, and suggest a side-bet to the players based on the results.

7. The computer-implemented method of claim 6, further comprising:

determining, based on the results, that one or more of the players are inactive indicating the one or more inactive players to the wagering game attendant.

* * * * *